US005222865A

United States Patent [19]

Corsmeier

[11] Patent Number: 5,222,865

[45] Date of Patent: Jun. 29, 1993

[54] PLATFORM ASSEMBLY FOR ATTACHING ROTOR BLADES TO A ROTOR DISK

[75] Inventor: Robert J. Corsmeier, Cincinnati, Ohio

[73] Assignee: General Electric Company, Cincinnati, Ohio

[21] Appl. No.: 939,573

[22] Filed: Sep. 3, 1992

Related U.S. Application Data

[63] Continuation of Ser. No. 664,007, Mar. 4, 1991, abandoned.

[51] Int. Cl.[5] ..... F01D 5/32

[52] U.S. Cl. ..... 416/193 A; 416/204 A; 416/220 R

[58] Field of Search ..... 416/193 R, 193 A, 95, 416/204 A, 220 R

[56] References Cited

U.S. PATENT DOCUMENTS

| | | | |
|---|---|---|---|
| 1,719,415 | 7/1929 | Back | 416/219 R |
| 1,793,468 | 2/1931 | Densmore | 416/219 R |
| 2,873,947 | 2/1959 | Perry | 416/220 R |
| 3,294,364 | 12/1966 | Stanley | 416/193 A |
| 3,309,058 | 3/1967 | Blackhurst et al. | 416/220 R |
| 3,393,862 | 7/1968 | Harrison | 416/193 A |
| 3,640,640 | 2/1972 | Palfreyman et al. | 416/220 R |
| 4,050,850 | 9/1977 | Beckershoff | 416/193 A |
| 4,097,276 | 6/1978 | Six | 416/193 A |
| 4,111,603 | 9/1978 | Stahl | 416/95 |
| 4,621,979 | 11/1986 | Zipps et al. | 416/193 A |
| 4,650,399 | 3/1987 | Craig et al. | 416/193 A |
| 4,655,687 | 4/1987 | Atkinson | 416/193 A |
| 4,802,824 | 2/1989 | Gastebois et al. | 416/193 A |
| 4,904,160 | 2/1990 | Partington | 416/220 R |
| 5,067,876 | 11/1991 | Moreman, III | 416/219 R |

FOREIGN PATENT DOCUMENTS

| | | | |
|---|---|---|---|
| 61-023802 | 2/1986 | Japan . | |
| 811922 | 4/1959 | United Kingdom | 416/193 A |
| 2006883 | 5/1979 | United Kingdom . | |
| 2186639 | 8/1987 | United Kingdom | 416/193 A |

*Primary Examiner*—John T. Kwon
*Attorney, Agent, or Firm*—Jerome C. Squillaro

[57] ABSTRACT

Nonmetallic airfoil blades are mounted to a rotor disk via a circumferentially spaced array of metal support members. Each support member includes a pair or circumferentially spaced arcuate or airfoil shaped dovetail engagement surfaces. The metal support members are secured to the rotor disk via straight dovetails while the rotor blades are secured to the support members via airfoil shaped dovetails. The support members may include hollow portions for channeling cooling air to the airfoil blades.

13 Claims, 6 Drawing Sheets

PLATFORM ASSEMBLY FOR ATTACHING ROTOR BLADES TO A ROTOR DISK

This application is a continuation of application Ser. No. 07/664,007, filed Mar. 4, 1991, now abandoned.

BACKGROUND OF THE INVENTION

1. Field of the Invention

The present invention relates in general to turbine rotors and particularly concerns the mounting of nonmetallic rotor blades having airfoil shaped dovetails to a rotor disk via a plurality of circumferentially spaced metal platform members having rotor blade support surfaces corresponding to the airfoil shaped dovetails of the rotor blades.

2. Description of Prior Developments

To improve the performance of turbines, new rotor blade materials have been developed. Such materials include both metals and nonmetallics. Nonmetallics, such as carbon/carbon and ceramics are lighter than metal and require little or no cooling. Unfortunately, most high temperature nonmetallic materials like carbon/carbon and ceramics do not have the bending capabilities of metal.

The inability to withstand significant bending loads presents a design problem insofar as the configuration of nonmetallic rotor blades is concerned. More particularly, rotor blades usually have a platform that forms the inner flowpath of the gas stream. For example, as seen in FIGS. 1 and 2, a metal rotor blade 10 includes a platform 12 which extends circumferentially outward in a cantilevered fashion on each side of the airfoil root section 14 of airfoil 15. When rotated during use, the platforms 12 are subjected to centrifugal bending loads as well as bending loads from the motive exhaust gases.

Metal platforms can be designed to withstand these bending loads but nonmetallic platforms of materials like carbon/carbon and ceramics have generally been considered incapable of reliably sustaining such loads. This has resulted in the use of metallic materials for the platforms. A previous attempt to solve the platform bending and loading problem involved removing the nonmetallic platform from the nonmetallic blade and replacing it with a metal platform.

As seen in FIGS. 3 through 6, a separate metal platform 16 was created to replace the integral nonmetallic platform 12 previously formed homogeneously with prior rotor blade designs of the type depicted in FIGS. 1 and 2. The metal platform 16 was equipped with forward and aft integral legs 18, 20 with a dovetail 22 formed on each leg. The dovetails 22 on each leg 18, 20 fit into the same disk dovetail slot 24 (FIGS. 5 and 6) as the rotor blade 10.

The platform 16 included an airfoil shaped hole 26 sized larger than the blade airfoil root section 14 to accommodate assembly of the platform 16 over the nonmetallic airfoil 30. This oversizing was required because the blade airfoil tip section 32 (FIG. 5) is typically larger in places than the root section 14.

The platform 16 was installed over the blade airfoil tip 32 and lowered down to the airfoil root 14. Next, the blade-platform assembly was inserted into and secured within the disk dovetail slot 24 via blade dovetails 33 and platform dovetails 22. Finally, as seen in FIG. 5, the forward then the aft blade seals and retainers 34, 36 were installed on the rotor disk 38.

A significant problem associated with using the separate metal platform 16 on the nonmetallic airfoil 30 of the type noted above is the excessive loss of precious cooling air 39 which spills out of the assembly clearance gap 40 defined between the airfoil root section 14 and the airfoil shaped hole 26 in the platform 16. This leakage is best seen in FIGS. 4 and 5. The cooling air 39 also leaks out between adjacent platform edges 42 at the flowpath surface 44 (FIGS. 5 & 6) and between the forward and aft legs 18, 20.

Another problem encountered with the use of the separate metal platform 16 is excessive bending experienced by its unsupported central portion 45. That is, the platform 16 bends at its center because it is only supported by the forward and aft legs 18, 20.

Referring again to FIGS. 1 and 2, another area, other than the blade platforms, where bending stress presents a significant design problem is in the blade shank area 46 through which the airfoil root 14 transitions into a straight dovetail neck 48. Critical high stress areas are located at the leading and trailing edges 50, 52 where the airfoil blade 15 extends circumferentially beyond the straight dovetail neck 48 creating a large offset angle 54. The larger the offset angle 54, the greater the bending load in the shank area 46. Even with a small offset angle, the resulting stress levels have been found unacceptable for nonmetallic materials like carbon/carbon and ceramics.

In order to improve the shank bending problem and loading problem associated with the design of FIGS. 1 and 2, two changes to the configuration of rotor blade 10 were made as shown in FIGS. 7 and 8. First, a costly curved dovetail 56 was introduced to help reduce the offset angle 54 in the shank area 46 adjacent the straight dovetail 58 of FIG. 1.

Next, the airfoil 15 was changed from a high camber shape to a low chamber shape. This reduction in camber also helped to reduce the offset angle 54 in the shank 46. Unfortunately, by changing the airfoil 15 from a high camber profile to a low camber profile, a significant loss in performance results.

Still another problem associated with the use of nonmetallic rotor blades having curved dovetails and curved dovetail necks 62 is the width of the disk dovetail post 60 (FIG. 6) which is, by necessity, extremely thin at the trailing edge 52. This thin section experiences relatively high stress levels during engine operation. Such stress can result in reduced life of the rotor disk.

A thin dovetail post is required because a carbon/carbon or ceramic blade will only work satisfactorily with a large single tang dovetail which is wider than conventional multiple tang or "fir tree" dovetails. Moreover, the nonmetallic airfoil 15 must transition into a relatively large dovetail neck 62 which provides the required support between the airfoil and the curved dovetail 56. If possible, the resulting thin dovetail post should be avoided.

Accordingly, a need exists for a rotor blade mounting assembly which avoids the problems associated with conventional metallic blade platforms and which readily accommodates the working stress levels present in modern gas turbine engine rotor blades.

SUMMARY OF THE INVENTION

The present invention has been developed to overcome the problems and fulfill the needs noted above and therefore has as an object the provision of a nonmetallic or ceramic airfoil blade which includes an optimum high camber airfoil contour and which avoids the use of homogeneously formed platforms of the type supported by conventional offset blade shank portions.

Another object of the invention is the provision of a nonmetallic or ceramic airfoil blade having a virtually shank-free configuration wherein the airfoil leads straight and directly into a blade dovetail without kinks, doglegs or offsets in the blade root and dovetail areas.

Another object of the invention is the provision of a metal platform for mounting a non-metallic or ceramic airfoil blade to a rotor disk in such a manner that leakage of the blade cooling air between the blade and platform is carefully controlled and such that impingement and/or film cooling is applied to the platforms and blades only where needed.

Still another object of the invention is the provision of an airfoil blade platform which is supported around its entire periphery so as to minimize undesirable platform bending.

Yet another object of the invention is to the provision of an airfoil blade and platform assembly which allows for the use of large, wide, low stress dovetail posts formed in the rim of a rotor disk.

Another object of the invention is the provision of nonmetallic or ceramic airfoil blade mounting platforms that have straight dovetails which allow the use of straight dovetail slots in a rotor disk. Such slots may be easily broached or formed in the rotor disk with a wire EDM apparatus.

Briefly, the present invention includes an airfoil blade and platform assembly wherein the airfoil blades do not connect directly to the disk by a dovetail fit or pinned connection or the like. Specially designed air cooled metal platforms are used to support nonmetallic or ceramic rotor blades. The root end of the blade airfoil terminates smoothly, without changing airfoil contour, into a specially designed dovetail.

The platforms are contoured to accept and compliment the blade airfoil and the special airfoil spaced dovetail. Adjacent platforms surround the blade airfoil root and dovetail securing it axially, circumferentially and radially. The platforms are mounted to the rotor disk via dovetail interconnections and are held axially within the disk by conventional blade seal/retainers.

Each platform includes a pressure chamber into which cooling air is channeled to cool the platform by convection and then by film cooling. Film cooling takes place as the cooling air passes through metering holes in the gas stream side of the platform or through holes strategically placed to cool the platform, disk rim and blade root area to acceptable temperatures.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawing, like reference characters designate like parts.

DETAILED DESCRIPTION OF THE PREFERRED EMBODIMENTS

Figure 2:
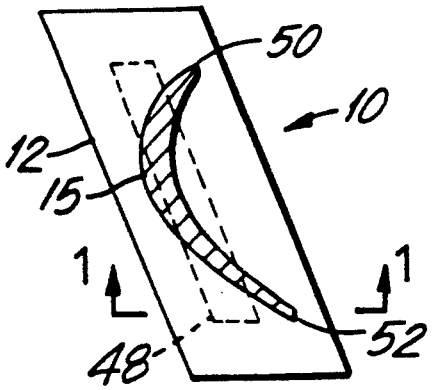
PRIOR ART FIG. 2
FIG. 2 is a partially sectioned top plan view of the prior art rotor blade of FIG. 1 showing a straight dovetail neck in phantom.
Figure 8:
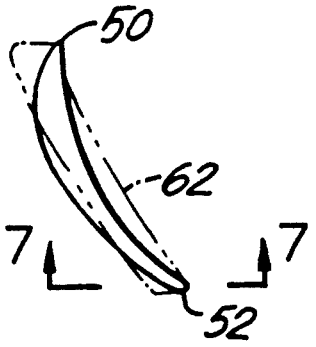
PRIOR ART FIG. 8
FIG. 8 is a top plan view of the rotor blade of FIG. 7 showing a curved dovetail neck in phantom.
Figure 1:
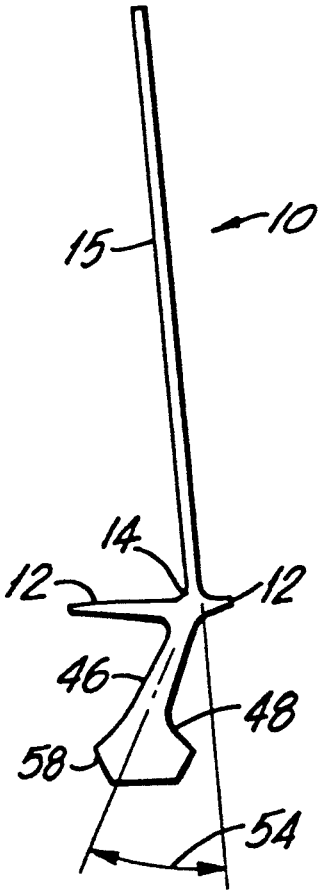
PRIOR ART FIG. 1
FIG. 1 is an aft view of a prior art metal rotor blade taken through line A—A of FIG. 2.
Figure 7:
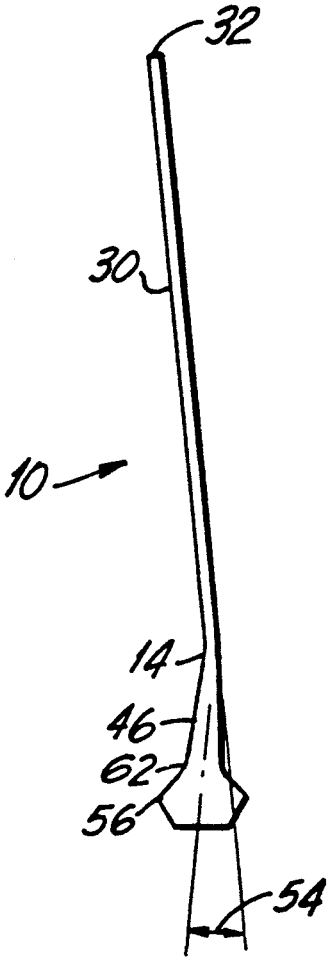
PRIOR ART FIG. 7
FIG. 7 is an aft view of the trailing edge of a prior art nonmetallic rotor blade taken along line C—C of FIG. 8.
Figure 3:
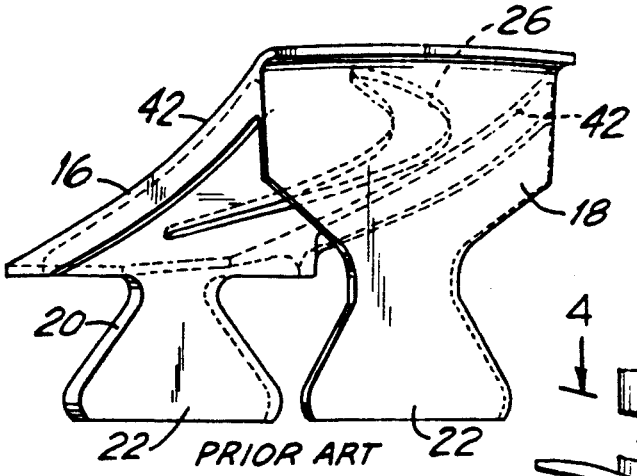
PRIOR ART FIG.3
FIG. 3 is a perspective view of a prior art metal platform designed for use with nonmetallic rotor blades.
Figure 4:
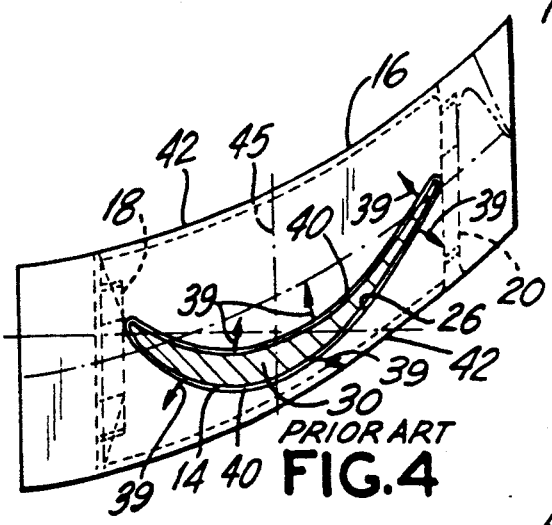
PRIOR ART FIG.4
FIG. 4 is a partially sectioned top plan view taken through line B—B of FIG. 5 showing the metal platform of FIG. 3 mounted around a non-metallic rotor blade airfoil according to the prior art.
Figure 6:
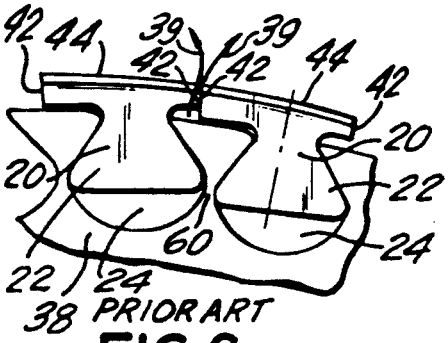
PRIOR ART FIG.6
FIG. 6 is a fragmental view of the trailing edge of the rotor disk rim and the metal platform dovetails of FIG. 5 with the airfoils and aft blade seal and retainer of FIG. 5 removed for clarity.
Figure 5:
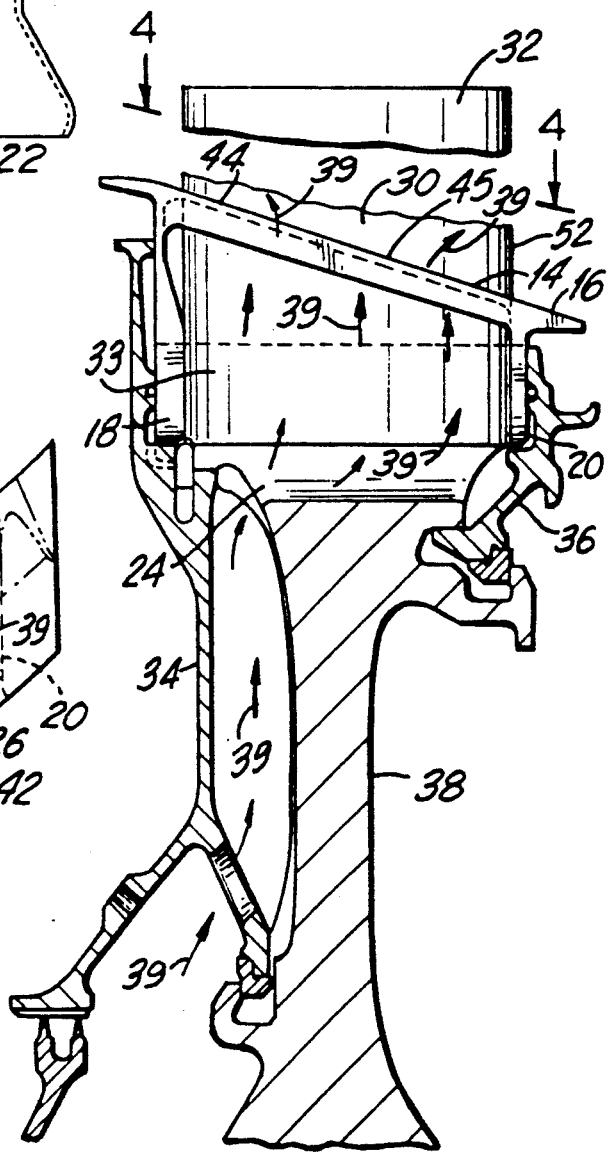
PRIOR ART FIG.5
FIG. 5 is a fragmental side elevation view of the metal platform of FIG. 3 mounted to a non-metallic rotor blade airfoil which, along with the metal platform, is mounted to a rotor disk of a gas turbine engine.
Figure 9:
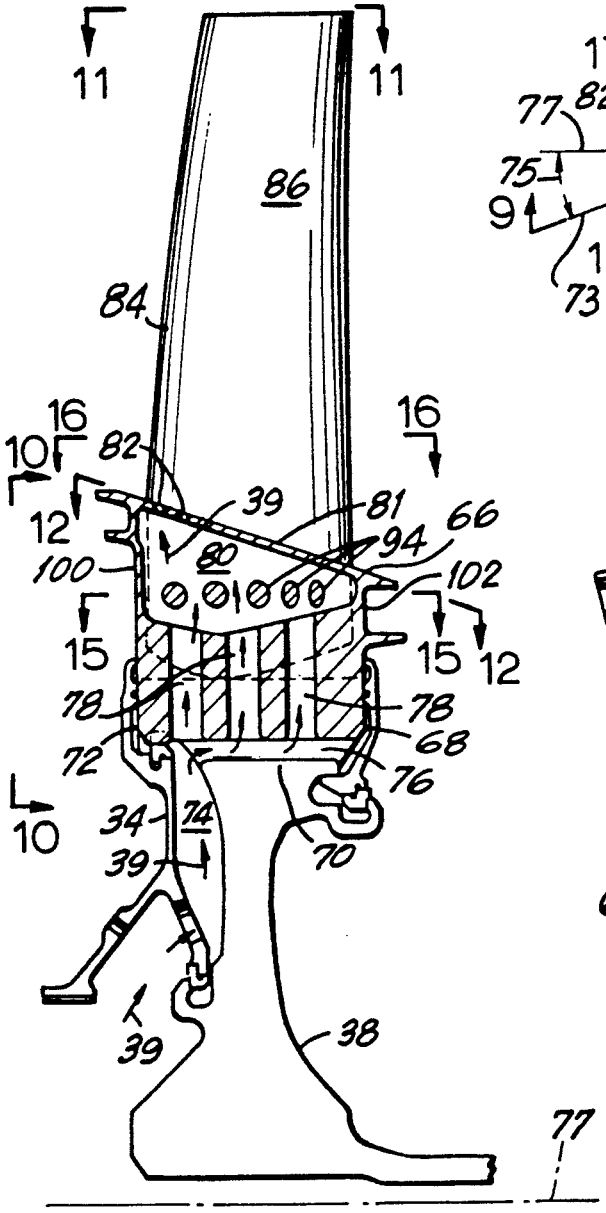
FIG. 9 is a side elevation view taken along line D—D of FIG. 11 of a non-metallic or ceramic rotor blade mounted to a rotor disk via metallic platforms designed in accordance with the present invention.
Figure 10:
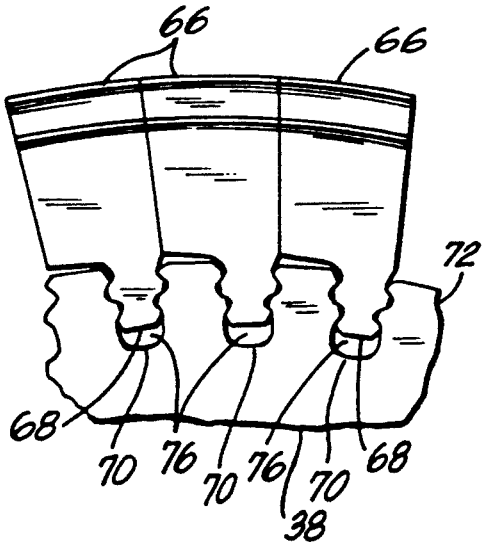
FIG. 10 is a fragmental view of the forward face of the assembly of FIG. 9 taken along line E—E thereof.

The present invention will now be described in conjunction with the drawings, beginning with FIGS. 9 and 10 which show a metal platform 66 connected to a rotor disk 38 by a multiple tang dovetail 68. Dovetail 68 extends axially, without curvature, on the platform 66 and is dimensioned for secure insertion into a matching straight dovetail slot 70 in the rotor disk 38.

Figure 11:
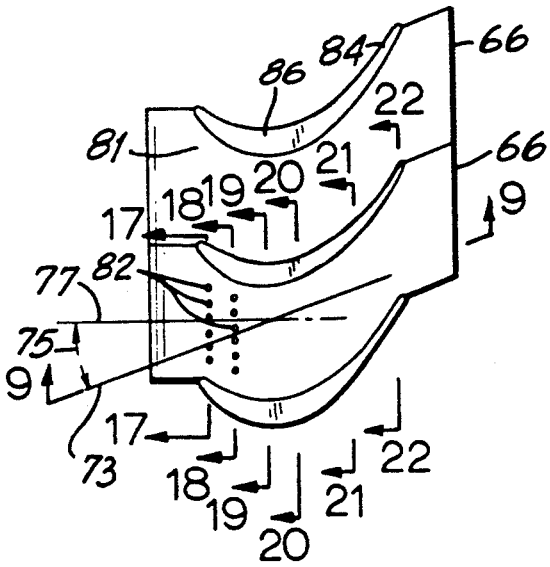
FIG. 11 is a top plan view of several rotor blades mounted to the rotor disk of FIG. 9 and taken along line F—F thereof.
Figure 16:
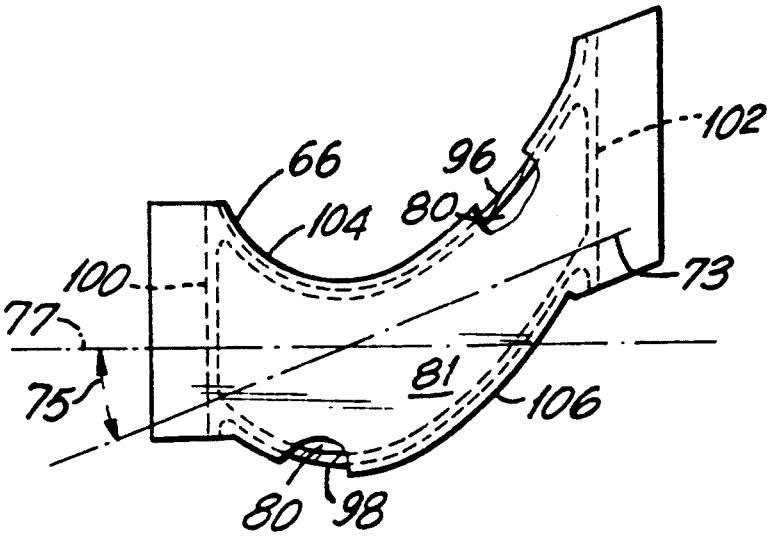
FIG. 16 is a sectional view taken along line L—L of FIG. 9.
Figure 13:
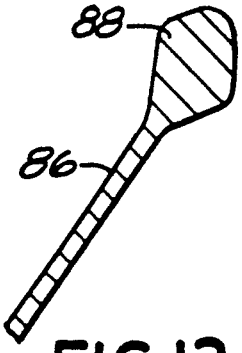
FIGS. 13 and 14 are sectional views taken respectively along lines H—H and J—J of FIG. 12.
Figure 14:
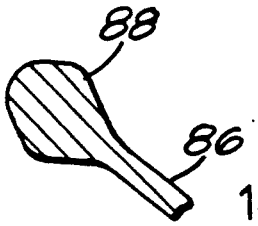
Figure 12:
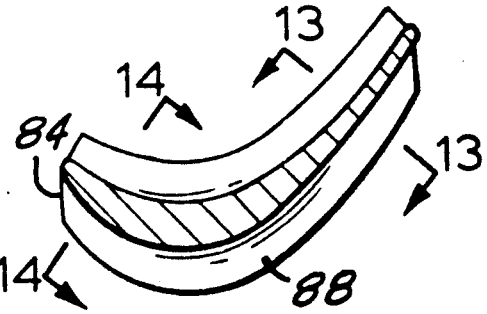
FIG. 12 is a sectional view taken along line G—G of FIG. 9.
Figure 15:
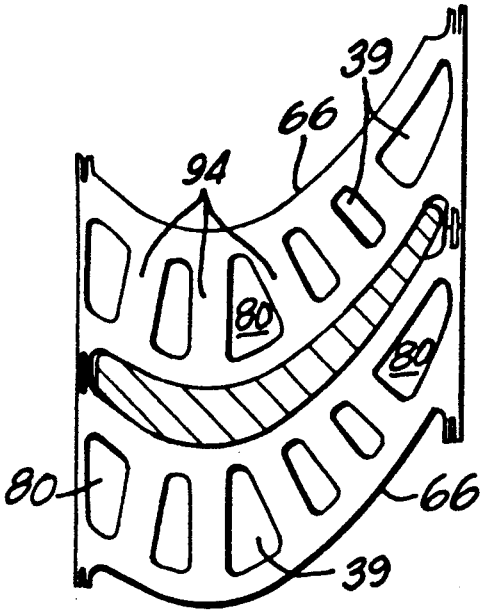
FIG. 15 is a sectional view taken along line K—K of FIG. 9.
Figure 21:
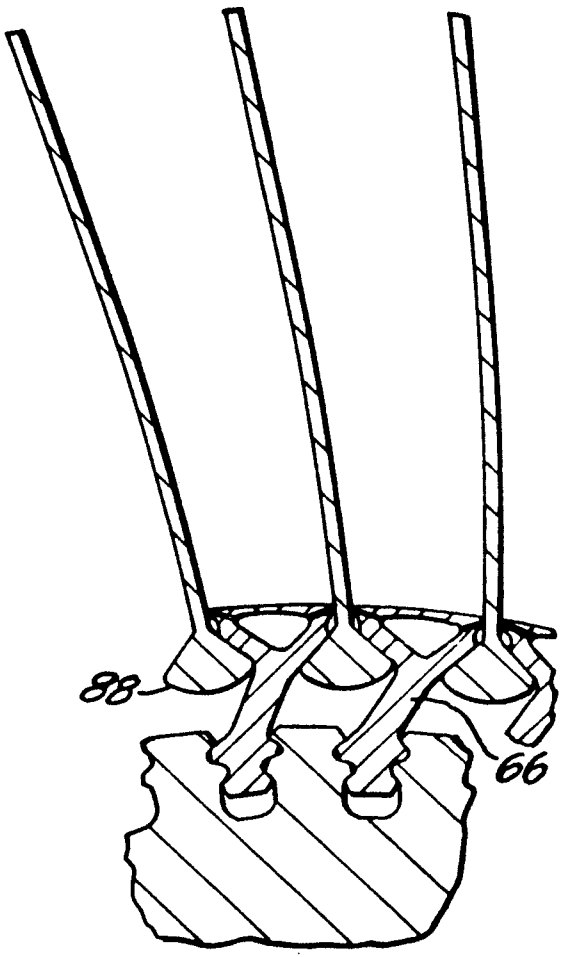
FIGS. 17 through 22 are sectional views respectively taken serially through lines M—M through R—R of FIG. 11.
Figure 19:
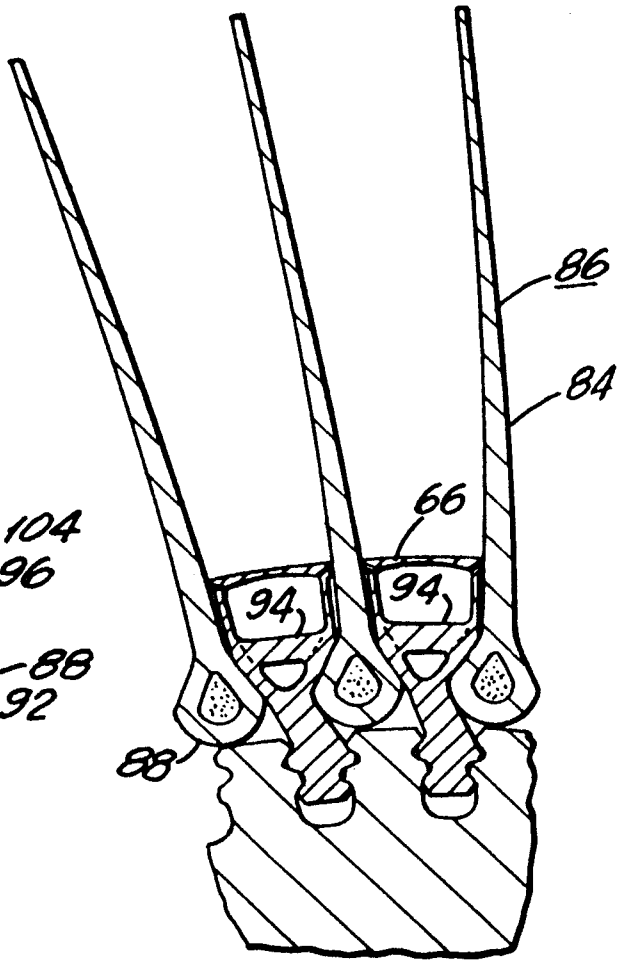

The dovetail 68 and dovetail slot 70 preferably run the full length of the rotor disk rim 72. The centerline 73 of dovetail 68 is shown in FIGS. 11 and 16 to form an angle 75 of about 20 degrees with respect to the centerline 77 of rotor disk 38.

Cooling air 39, such as compressor discharge pressure air, is used to cool the platform 66 and rotor disk rim 72. The cooling air 39 enters the plenum 74 formed by the forward blade seal and retainer 34 and rotor disk 38 and passes into a cavity 76 formed between the bottom of the disk dovetail slot 70 and the base of the platform dovetail 68. From cavity 76, the cooling air 39 flows up through bore holes or channels 78 formed in the platform dovetail 68 and then into a platform chamber 80.

The cooling air 39 is used to convection cool the platform 66 before it passes out through film cooling holes 82 formed in the top wall or roof 81 of platform 66 which defines the inner surface of the gas stream flowpath. Film cooling holes 82 may be placed anywhere it is deemed necessary to help cool the platform 66, rotor blade 84, or disk rim 72.

The disk rim 72 will run cooler than prior designs because the rotor blades 84 are separated from the disk rim 72 and will not conduct heat from the hot gas stream via blade airfoils or blade dovetails.

The rotor blade 84 does not have a conventional shank portion where conventional airfoils transition to a dovetail neck. Instead, the airfoil 86 leads smoothly and directly into a dovetail 88. This is best seen in FIGS. 12, 13 and 14, and 17 through 22. It should be noted that there are no kinks, doglegs, or offset angles in the continuous, smooth, even contour of airfoil 86 as it joins the dovetail 88.

As further seen in FIGS. 17 through 22, the platforms 66 are provided with angled arcuate or airfoil shaped axially extending support surfaces 90 and 92 that compliment and mate with the curved or airfoil shaped blade dovetail 88. These support surfaces retain the rotor blade 84 as described earlier. The platforms 66 are also provided with optional transverse support columns 94 as seen in FIGS. 9, 15, 18 and 19 that may be required to help support the angled surfaces 90 and 92.

Figure 17:
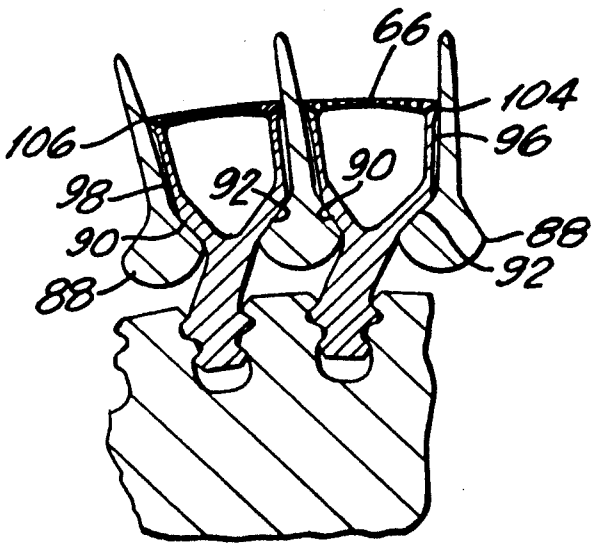
Figure 22:
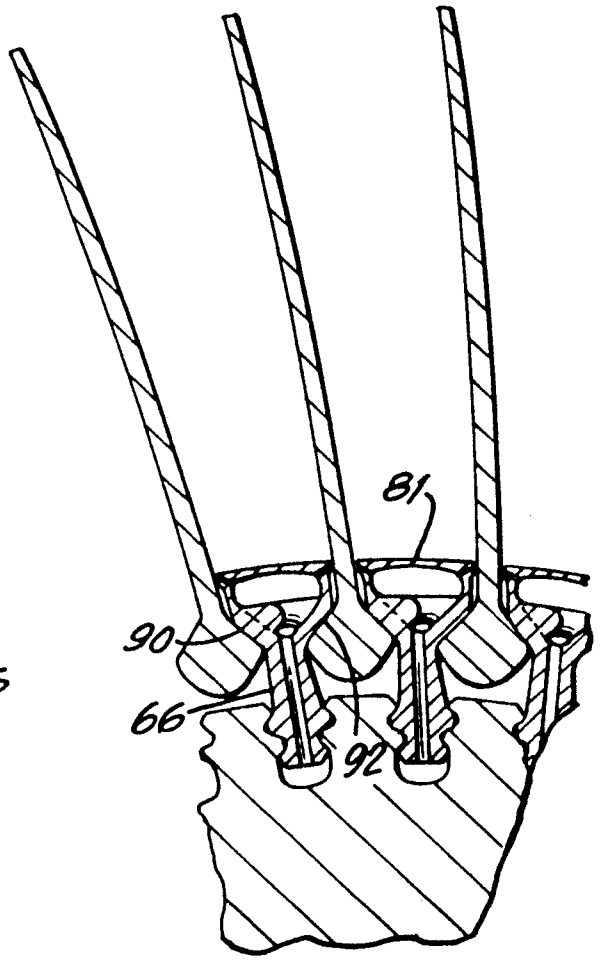
Figure 20:
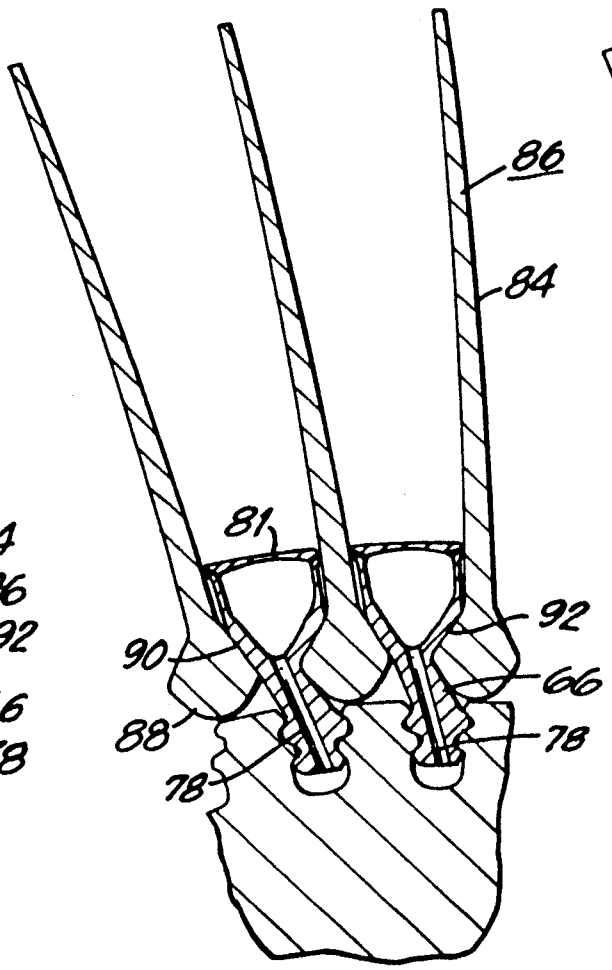
Figure 18:
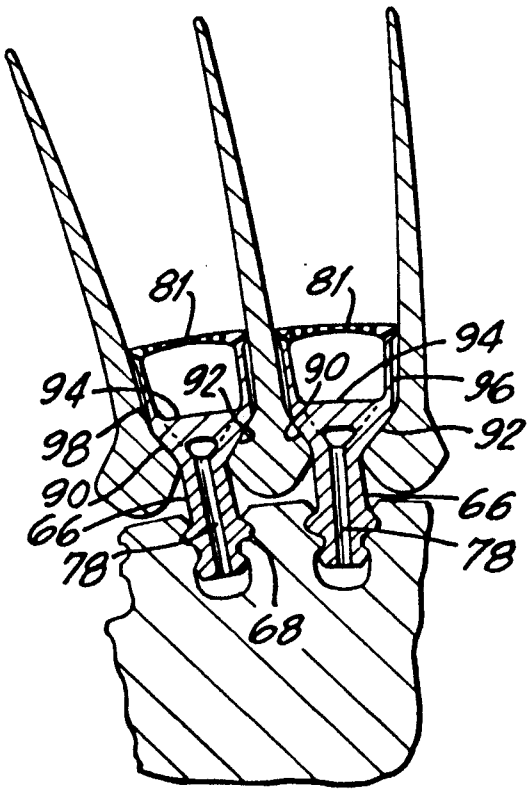

The upright concave side wall 96 and convex side wall 98 seen in FIGS. 16, 17 and 18 along with the flat or planar forward wall 100 and flat or planar aft wall 102 provide all around support for the slightly arched platform roof 81 and help form the pressure chamber needed to contain the cooling air 39.

Because the blade is supported and located by the angled surfaces 90 and 92 the concave edge 104 and convex edge 106 (FIG. 16) on the platform 66 can be easily sized to come close to but not touch the more delicate nonmetallic blade airfoil 86. This will prevent fretting of the blade due to friction.

There has been disclosed a heretofore the best embodiment of the invention presently contemplated. However, it is to be understood that various changes and modifications may be made thereto without departing from the spirit of the invention. For example, platforms 66 could include serpentine cooling passages. Moreover, platforms 66 need not necessarily be formed exclusively of metal in which case air cooling could be optional.

What is claimed is:

1. A platform member for attaching airfoil blades to a rotor disk, said platform member comprising a tail portion for engaging said disk, a first axially-extending arcuate blade dovetail support surface connected to said tail portion for engaging and radially supporting an arcuate surface portion of one airfoil blade dovetail, a second axially-extending arcuate blade dovetail support surface connected to said tail portion for engaging and radially supporting an arcuate surface portion of another airfoil blade dovetail, and a top wall which defines an inner surface of a gas stream.

2. The platform of claim 1, wherein said first arcuate blade dovetail support surface comprises a concave surface and wherein said second arcuate blade dovetail support surface comprises a convex surface.

3. The platform of claim 1, wherein said tail portion is formed with internal channels for conducting cooling air to said blades.

4. The platform of claim 2, further comprising support means extending between said first and second dovetail support surfaces.

5. The platform of claim 4, wherein said support means comprises a plurality of columns.

6. The platform of claim 1, wherein said first and second blade dovetail support surfaces diverge from said tail portion toward said airfoil blades.

7. The platform of claim 1, further comprising a first arcuate side wall connected to said first blade dovetail support surface, a second arcuate side wall connected to said second blade dovetail support surface and a top wall extending between said first and second side walls.

8. The platform of claim 7, further comprising a forward wall and an aft wall each connected to said first and second side walls and to said top wall so as to form a chamber within said platform.

9. The platform of claim 8, wherein said forward wall and said aft wall each comprises planar wall portions.

10. The platform of claim 8, wherein said top wall includes a plurality of cooling air holes formed therein.

11. A platform member for attaching airfoil blades to a rotor disk, said platform member comprising a tail portion for engaging said disk, a first arcuate blade support surface connected to said tail portion for supporting one airfoil blade, a second arcuate blade support surface connected to said tail portion for supporting another airfoil blade, and said tail portion being formed with internal channels for conducting cooling air to said blades.

12. A platform member for attaching airfoil blades to a rotor disk, said platform member comprising a tail portion for engaging said disk, a first arcuate blade support surface connected to said tail portion for supporting one airfoil blade, a second arcuate blade support surface connected to said tail portion for supporting another airfoil blade, a first arcuate side wall connected to said first blade support surface, a second arcuate side wall connected to said second blade support surface, a top wall extending between said first and second side walls, a forward planar wall and an aft planar wall each connected to said first and second side walls and to said top wall so as to form a chamber within said platform, and a plurality of cooling air holes formed in said top wall.

13. A platform member for mounting airfoil blades above a rotor disk rim such that said blades are substantially separated from said rim, said platform member comprising a tail portion for engaging said disk, a first arcuate support surface connected to said tail portion for supporting a first airfoil blade a second arcuate support surface connected to said tail portion for supporting a second airfoil blade, and a top wall which defines an inner surface of a gas stream flowpath, said first and second arcuate support surfaces each comprising means for respectively supporting first and second airfoil blades axially, circumferentially and radially.

* * * * *